US007352140B2

(12) United States Patent
Chou et al.

(10) Patent No.: US 7,352,140 B2
(45) Date of Patent: Apr. 1, 2008

(54) MASTER-SLAVE CONTROL ARCHITECTURE FOR INVERTERS

(75) Inventors: Chin-Wen Chou, Taipei Hsien (TW); Ying-Nan Cheng, Taipei Hsien (TW); Kuang-Ming Wu, Taipei Hsien (TW); Chin-Biau Chung, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 11/188,627

(22) Filed: Jul. 26, 2005

(65) Prior Publication Data

US 2007/0024199 A1 Feb. 1, 2007

(51) Int. Cl.
*H05B 37/00* (2006.01)

(52) U.S. Cl. ..... 315/312; 315/274; 315/276; 315/324; 315/291

(58) Field of Classification Search ..... 315/307–326, 315/216, 226, 294–301, 274–291, 210
See application file for complete search history.

(56) References Cited

U.S. PATENT DOCUMENTS 5,229,927 A * 7/1993 Vila-Masot et al. ..... 363/23
5,825,135 A * 10/1998 Chang ..... 315/291
6,075,325 A * 6/2000 Kouno et al. ..... 315/307
6,791,239 B2 * 9/2004 Chou et al. ..... 310/318
7,187,139 B2 * 3/2007 Jin ..... 315/274
2002/0097004 A1 * 7/2002 Chiang et al. ..... 315/224
2004/0015560 A1 1/2004 Yamaguchi et al.
2004/0095039 A1 * 5/2004 Chou et al. ..... 310/318
2007/0024209 A1 * 2/2007 Chou et al. ..... 315/291

FOREIGN PATENT DOCUMENTS

JP 2003229288 A * 8/2003

* cited by examiner

*Primary Examiner*—Tuyet Vo
(74) *Attorney, Agent, or Firm*—Birch, Stewart, Kolasch & Birch, LLP

(57) ABSTRACT

A master-slave control architecture for inverters includes a master control circuit board which has a master control unit to output a plurality of frequency signals of the same phase and same frequency so that driving units on a plurality of separated slave control circuit boards on the rear end can be driven synchronously by the frequency signals to control electricity input of transformation units to transform voltage for outputting. Thereby the frequency of the driving electricity of the discharge lamps can be synchronized to maintain uniform luminance.

14 Claims, 2 Drawing Sheets

MASTER-SLAVE CONTROL ARCHITECTURE FOR INVERTERS

FIELD OF THE INVENTION

The present invention relates to a master-slave control architecture for inverters and particularly to an inverter for driving discharge lamps with electricity that synchronously outputs equal electricity through multiple sets of signals that have same phase and frequency to drive a plurality of discharge lamps to achieve uniform luminance.

BACKGROUND OF THE INVENTION

Electricity control techniques for inverters are known in the art. U.S. Pat. No. 6,791,239 proposed by the Applicant is such an example. That technique focuses on the conventional inverter circuit and includes an individual pulse-width modulation (PWM) control unit, a driving unit, and a transformation unit to drive each discharge lamp (CCFL or EEFL). As the size of display panels increases gradually, the number of the discharge lamps also increases. The required electricity increases too. Hence the size of circuit board to accommodate the configuration of the PWM control unit, driving unit and transformation unit made according to the number of discharge lamps is larger, and circuit layout and production are more difficult. Illumination and electric field interference among the discharge lamps also increases. As a result, luminance uniformity suffers. While the aforesaid technique provides a solution, it mainly aims to provide, through a single PWM control unit, synchronous driving signals of the same phase and same frequency according to the driving units and transformation units that are required to drive the discharge lamps on the rear end. Thereby each driving unit, transformation unit and discharge lamp can be driven synchronously to achieve the uniform luminance.

However, with the size of the display panel increased constantly, the number of the discharge lamps increases even more. The circuit board has to be fabricated separately. Each separated circuit board includes a single PWM control unit to drive a plurality of driving units, transformation units and discharge lamps. The PWM control unit on each circuit board could encounter different frequency signals. For instance, U.S. patent publication No. 2004/0155601 A1 discloses a technique which arranges the discharge lamps in a staggered fashion. The problem of non-uniform luminance of the discharge lamps becomes more severe.

SUMMARY OF THE INVENTION

Therefore the primary object of the present invention is to solve the aforesaid problems. The invention provides an architecture that includes a signal master control circuit board which has a main control unit to output a plurality of frequency signals of the same phase and same frequency so that driving units on a plurality of separated slave control circuit boards on the rear end can be driven synchronously by the frequency signals to control electricity input of transformation units to transform voltage for outputting. Thereby the frequency of driving electricity of the discharge lamps can be synchronized to maintain uniform luminance.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
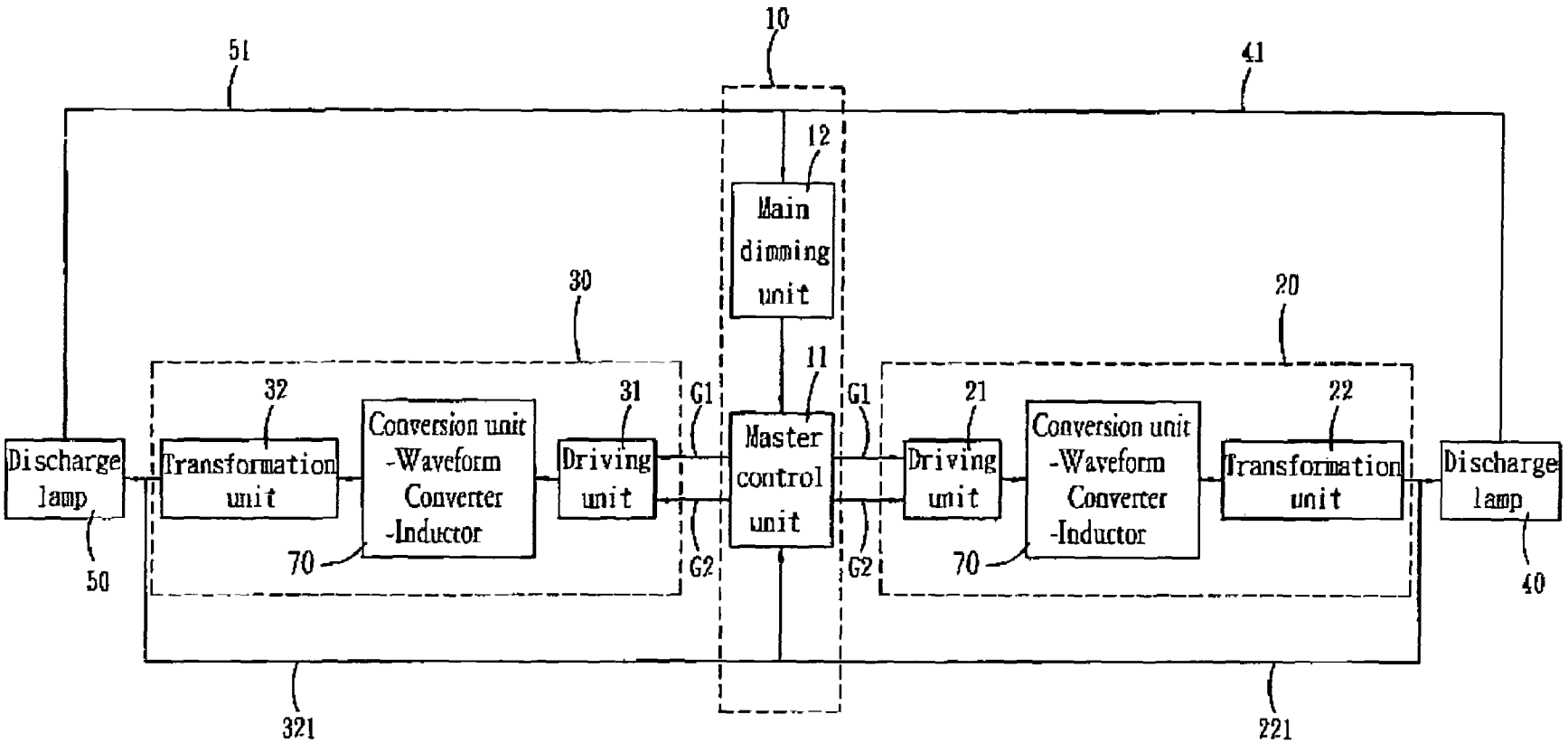
FIG. 1 is a circuit block diagram of a first embodiment of the present invention.

Please refer to FIG. 1 for the circuit block diagram of a first embodiment of the invention. It is a master-slave control architecture for inverters. It mainly includes a master control circuit board 10 which has a master control unit 11 to output two or more frequency signals G1 and G2 of the same phase and same frequency. The front end of the master control unit 11 is connected to a main dimming unit 12. The master control unit 11 and the main dimming unit 12 may be a PWM controller or IC. The invention further has one or more slave control circuit boards 20 and 30 corresponding to the number of discharge lamps 40 and 50. The slave control circuit boards 20 and 30 are separated from the master control circuit board 10. Each of the slave control circuit boards 20 and 30 has a driving unit 21, 31 and a transformation unit 22, 32 that are connected electrically. The driving units 21 and 31 are synchronously driven by the frequency signals G1 and G2 output from the master control unit 11 to control electricity input of the transformation units 22 and 32 to transform voltage for outputting. The transformed driving electricity is output to the discharge lamps 40 and 50 at the rear end. According to the existing techniques, the transformation units 22 and 32 consist of one or more transformers. In the embodiment of the invention, the transformer is a piezoelectric transformer. The transformer and the driving units 21 and 31 are bridged by a conversion unit 70 such as a waveform converter or inductor. The number and size of the discharge lamps 40 and 50 are corresponding to the driving electricity output from the transformation units 22 and 32. The electric driving mode of the transformation units 22 and 32, and the discharge lamps 40 and 50 can be single driving or push-pull driving. Moreover, the discharge lamps 40 and 50 output respectively a tube current detection signal 41 and 51 that are sent jointly to the main dimming unit 12 to regulate luminance setting of the discharge lamps 40 and 50. And the transformation units 22 and 32 also output respectively a voltage detection signal 221 and 321 that are sent jointly to the master control unit 11 to protect line interruption or abnormal conditions.

Figure 2:
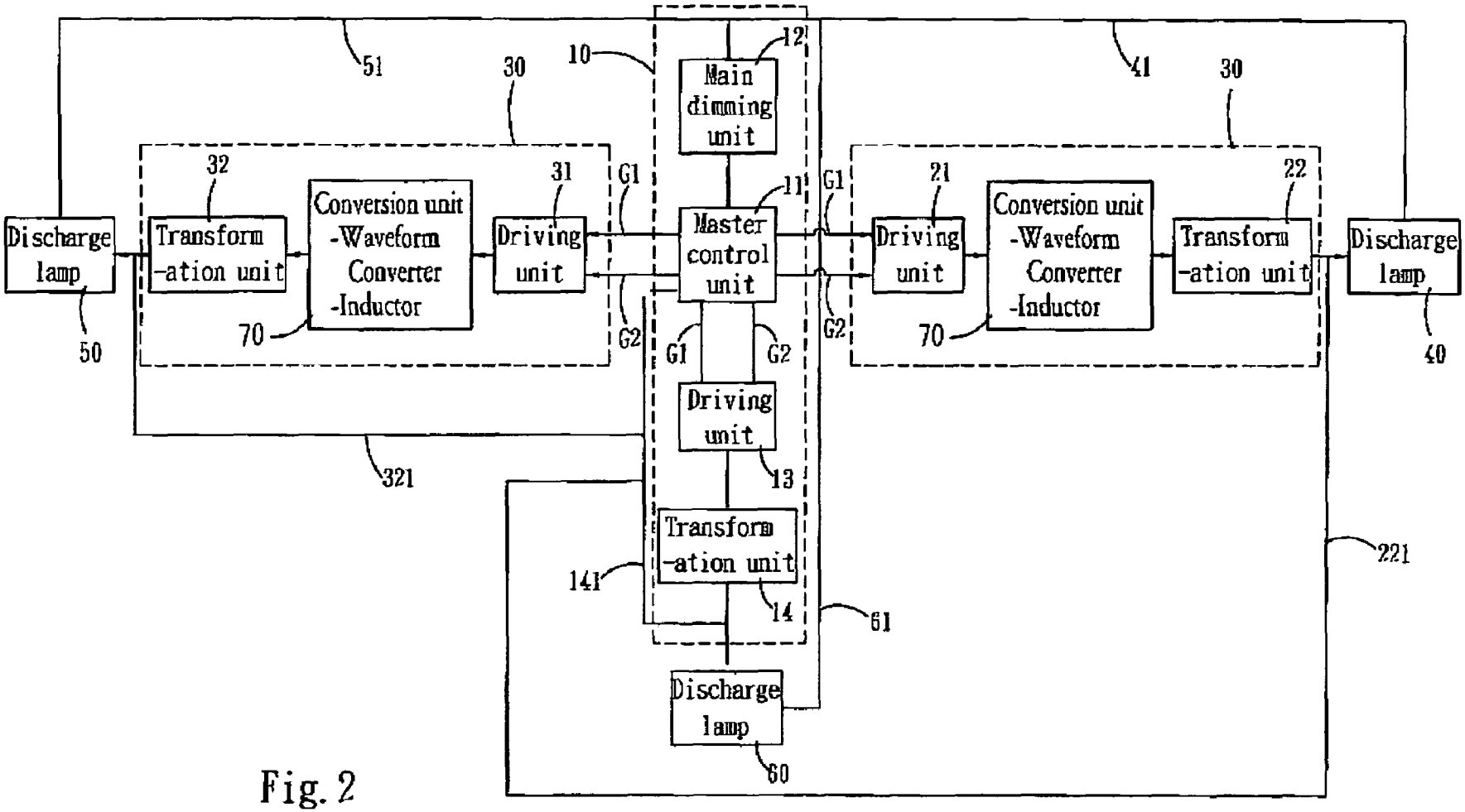
FIG. 2 is a circuit block diagram of a second embodiment of the present invention.

Refer to FIG. 2 for the circuit block diagram of a second embodiment of the invention. It differs from the first embodiment by having another driving unit 13 and another transformation unit 14 on the master control circuit board 10 to synchronously receive the frequency signals G1 and G2 of the same phase and same frequency from the master control unit 11 to transform electricity, then drive another discharge lamp 60 at the rear end. The discharge lamp 60 also outputs a tube current detection signal 61 to the main dimming unit 12 to regulate luminance setting of the discharge lamp 60. The transformation unit 14 also outputs a voltage detection signal 141 to the master control unit 11 to protect line interruption or abnormal conditions. Based on the first and second embodiments, it is clear that whatever the number of the discharge lamps 40, 50 and 60, one master control circuit board 10 and a plurality of slave control circuit boards 20 and 30 can be adopted. Hence there is no need to increase the size of the master control circuit board 10 and the slave control boards 20 and 30. Circuit layout also is simpler and easy to fabricate. Moreover, the master control circuit board 10 has a single master control unit 11 to synchronously output a plurality of frequency signals G1 and G2 of the same phase and same frequency respectively to the driving units 13, 21 and 31 of the slave control circuit boards 20 and 30, and the driving units 13, 21 and 31 can synchronously activate and control electricity input of the transformation units 14, 22 and 32, thereby the transformation units 14, 22 and 32 can synchronously drive the discharge lamps 40, 50 and 60. Thus all of the discharge lamps 40, 50 and 60 can be driven by equal amount of electricity to reach a uniform luminance.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A master-slave control architecture for inverters, comprising:

a master control circuit board which has a master control unit to output at least two frequency signals of a same phase and a same frequency;

at least one slave control circuit board separated from the master control circuit board, each slave control circuit board having a driving unit and a transformation unit that are connected electrically, the driving unit being synchronously driven by at least one of the frequency signals output from the master control unit to control electricity input of the transformation unit to transform voltage for outputting; and at least one discharge lamp which is electrically connected to the transformation unit and driven by the electricity output from the transformation unit.

2. The master-slave control architecture for inverters of claim 1, wherein the transformation unit outputs a voltage detection signal to the master control unit.

3. The master-slave control architecture for inverters of claim 1, wherein the master control unit has a front end connecting to a main dimming unit.

4. The master-slave control architecture for inverters of claim 3, wherein the discharge lamp outputs a tube current detection signal which is sent to the main dimming unit.

5. The master-slave control architecture for inverters of claim 1, wherein the transformation unit includes at least one transformer.

6. The master-slave control architecture for inverters of claim 5, wherein the transformer is a piezoelectric transformer, the transformer and the driving unit being bridged by a conversion unit.

7. The master-slave control architecture for inverters of claim 6, wherein the conversion unit is a waveform converter or an inductor.

8. The master-slave control architecture for inverters of claim 1, wherein the master control circuit board includes a driving unit and a transformation unit.

9. The master-slave control architecture for inverters of claim 8, wherein the transformation unit outputs a voltage detection signal to the master control unit.

10. The master-slave control architecture for inverters of claim 8, wherein the master control unit has a front end connecting to the main dimming unit.

11. The master-slave control architecture for inverters of claim 10, wherein the discharge lamp outputs a tube current detection signal which is sent to the main dimming unit.

12. The master-slave control architecture for inverters of claim 8, wherein the transformation unit includes at least one transformer.

13. The master-slave control architecture for inverters of claim 12, wherein the transformer is a piezoelectric transformer, the transformer and the driving unit being bridged by a conversion unit.

14. The master-slave control architecture for inverters of claim 13, wherein the conversion unit can be selected from a waveform converter and an inductor.

* * * * *